US010351372B2

(12) United States Patent
Wakakusa

(10) Patent No.: US 10,351,372 B2
(45) Date of Patent: Jul. 16, 2019

(54) SHEET CONVEYOR AND IMAGE RECORDING APPARATUS

(71) Applicant: BROTHER KOGYO KABUSHIKI KAISHA, Nagoya-shi, Aichi-ken (JP)

(72) Inventor: Keisuke Wakakusa, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 512 days.

(21) Appl. No.: 15/076,843

(22) Filed: Mar. 22, 2016

(65) Prior Publication Data

US 2016/0332831 A1 Nov. 17, 2016

(30) Foreign Application Priority Data

May 11, 2015 (JP) ..... 2015-096935

(51) Int. Cl.

| | |
|---|---|
| ***B65H 1/04*** | (2006.01) |
| ***B65H 5/26*** | (2006.01) |
| ***B65H 3/06*** | (2006.01) |
| ***B65H 1/02*** | (2006.01) |

(52) U.S. Cl.

CPC ..... *B65H 5/26* (2013.01); *B65H 1/02* (2013.01); *B65H 1/04* (2013.01); *B65H 3/0684* (2013.01); *B65H 2402/31* (2013.01); *B65H 2402/46* (2013.01); *B65H 2403/533* (2013.01); *B65H 2405/324* (2013.01); *B65H 2407/21* (2013.01); *B65H 2801/12* (2013.01)

(58) Field of Classification Search

CPC ... B65H 5/26; B65H 1/02; B65H 1/04; B65H 3/0684; B65H 2402/31; B65H 2402/46; B65H 1/027; B65H 2405/31; B65H 2405/32; B65H 2405/35

See application file for complete search history.

(56) References Cited

U.S. PATENT DOCUMENTS

| | | | | |
|---|---|---|---|---|
| 7,597,317 | B2 * | 10/2009 | Okuda | B41J 3/4071 270/58.07 |
| 7,694,950 | B2 * | 4/2010 | Shiohara | B41J 11/485 271/9.08 |
| 7,748,691 | B2 * | 7/2010 | Mizuguchi | B65H 1/04 271/162 |
| 2008/0107446 | A1 | 5/2008 | Ohtsuki | |
| 2011/0101601 | A1 * | 5/2011 | Yoda | B65H 31/02 271/163 |

FOREIGN PATENT DOCUMENTS

| | | | |
|---|---|---|---|
| JP | 10-231051 | A | 9/1998 |
| JP | 2007-284172 | A | 11/2007 |

* cited by examiner

*Primary Examiner* — Thomas A Morrison
(74) *Attorney, Agent, or Firm* — Merchant & Gould P.C.

(57) ABSTRACT

A sheet conveyor includes a tray and a body supporting the tray. The tray is pivotable about a first shaft between a first position at which a free end of the tray is located above its basal end and a second position at which the free end is located farther from the body than at the first position. The tray is slidable between the second position and a third position and pivotable about a second shaft between the third position and a fourth position at which the free end is located farther from the body than at the third position. The first shaft protrudes from one of the tray and the body toward the other. The second shaft protrudes from the other to the one. The other includes a first guide that guides the first shaft. The one includes a second guide that guides the second shaft.

10 Claims, 9 Drawing Sheets

SHEET CONVEYOR AND IMAGE RECORDING APPARATUS

CROSS REFERENCE TO RELATED APPLICATION

The present application claims priority from Japanese Patent Application No. 2015-096935, which was filed on May 11, 2015, the disclosure of which is herein incorporated by reference in its entirety.

BACKGROUND

Technical Field

The following disclosure relates to a sheet conveyor capable of conveying a sheet and to an image recording apparatus including the sheet conveyor and capable of recording an image on the sheet conveyed by the sheet conveyor.

Description of the Related Art

There are known image recording apparatuses, e.g., printers, including a sheet conveyor for conveying a sheet. Many image recording apparatuses are provided with a pivotable manual tray for supporting sheets to be supplied into the image recording apparatus.

When no sheet is placed on the manual tray, the manual tray is located at a standing position at which the manual tray stands with respect to a body of the image recording apparatus. When sheets are to be placed on the manual tray, the manual tray is swung from the standing position to an inclined position at which the manual tray is inclined with respect to the body of the image recording apparatus.

SUMMARY

Users may desire to swing the manual tray from the inclined position to a distant position that is located farther from the standing position than the inclined position. For example, when the manual tray is located at the distant position, a larger space is formed between the manual tray and the body of the image recording apparatus. This state allows a user to easily remove a sheet jammed in the image recording apparatus. Also, for example, when the manual tray is located at the distant position, the manual tray extends horizontally. In the case where the image recording apparatus can perform image recording on a media having greater stiffness than sheets such as a CD and a DVD, when the manual tray extends horizontally, such a media can be supplied into the image recording apparatus without hindered by the manual tray.

However, a problem described below may arise in the case where the manual tray is constructed so as to be swung from the standing position to the inclined position and from the inclined position to the distant position about the same axis. That is, when a large force is applied to the manual tray when the user swings the manual tray from the standing position to the inclined position, the manual tray may be swung to the distant position by passing through the inclined position. That is, the position of the manual tray cannot be kept stably.

Also, there is known an image recording apparatus in which a cover supporting a manual tray can be swung to enlarge a space between the manual tray and a body of the image recording apparatus. In the image recording apparatus, however, the manual tray and the cover are not coaxial, but a direction in which the manual tray is swung and a direction in which the cover is swung coincide with each other. Thus, in the case where a large force is applied to the manual tray when the user swings the manual tray, the cover may be swung erroneously. Also, providing the cover increases the number of components, resulting in increase in size of the image recording apparatus.

Accordingly, an aspect of the disclosure relates to a sheet conveyor and an image recording apparatus in which a tray can be movable to a standing position, an inclined position, and a distant position, and the tray can be kept at the inclined position stably.

In one aspect of the disclosure, a sheet conveyor includes: a tray that supports a sheet; and a body that supports the tray. The body has a conveyance path through which the sheet supported by the tray is to be conveyed. The tray has a basal end and a free end and pivotable between a first position and a second position about a first shaft. The first position is a position at which the free end is located above the basal end. The second position is a position at which the tray supports the sheet in a state in which the free end is located farther from the body than the free end of the tray located at the first position. The tray is slidable along a slide direction between the second position and a third position. The tray is pivotable between the third position and a fourth position about a second shaft. The fourth position is a position at which the free end is located farther from the body than the free end of the tray located at the third position. The first shaft protrudes from one of the tray and the body toward the other of the tray and the body. The second shaft protrudes from the other of the tray and the body to the one of the tray and the body. The other of the tray and the body includes a first guide that guides the first shaft in a state in which the first shaft is inserted in the first guide. The one of the tray and the body includes a second guide that guides the second shaft in a state in which the second shaft is inserted in the second guide. The first guide has (i) a first elongated hole having a first end and a second end and extending in the slide direction and (ii) a second elongated hole having a first end and a second end. The first end of the second elongated hole is continuous to the first end of the first elongated hole. The second elongated hole extends from the first end thereof in a direction in which the tray is swung from the third position to the fourth position. The second guide has (i) a third elongated hole having a first end and a second end and extending in the slide direction and (ii) a fourth elongated hole having a first end and a second end. The first end of the fourth elongated hole is continuous to the first end of the third elongated hole. The fourth elongated hole extends from the first end thereof in a direction in which the tray is swung from the first position to the second position. The first shaft and the second shaft are respectively located at the second end of the first elongated hole and the second end of the fourth elongated hole in a state in which the tray is located at the first position. The first shaft and the second shaft are respectively located at the second end of the first elongated hole and the first end of the third elongated hole in a state in which the tray is located at the second position. The first shaft and the second shaft are respectively located at the first end of the first elongated hole and the second end of the third elongated hole in a state in which the tray is located at the third position. The first shaft and the second shaft are respectively located at the second end of the second elongated hole and the second end of the third elongated hole in a state in which the tray is located at the fourth position.

In another aspect of the disclosure, an image recording apparatus includes: a tray that supports a sheet; a body that supports the tray, the body having a conveyance path through which the sheet supported by the tray is to be conveyed; and an image recorder that records an image on the sheet conveyed along the conveyance path. The tray has a basal end and a free end and pivotable between a first position and a second position about a first shaft. The first position is a position at which the free end is located above the basal end. The second position is a position at which the tray supports the sheet in a state in which the free end is located farther from the body than the free end of the tray located at the first position. The tray is slidable along a slide direction between the second position and a third position. The tray is pivotable between the third position and a fourth position about a second shaft. The fourth position is a position at which the free end is located farther from the body than the free end of the tray located at the third position. The first shaft protruding from one of the tray and the body toward the other of the tray and the body. The second shaft protruding from the other of the tray and the body to the one of the tray and the body. The other of the tray and the body includes a first guide that guides the first shaft in a state in which the first shaft is inserted in the first guide. The one of the tray and the body includes a second guide that guides the second shaft in a state in which the second shaft is inserted in the second guide. The first guide has (i) a first elongated hole having a first end and a second end and extending in the slide direction and (ii) a second elongated hole having a first end and a second end. The first end of the second elongated hole is continuous to the first end of the first elongated hole. The second elongated hole extends from the first end thereof in a direction in which the tray is swung from the third position to the fourth position. The second guide has (i) a third elongated hole having a first end and a second end and extending in the slide direction and a fourth elongated hole having a first end and a second end. The first end of the fourth elongated hole is continuous to the first end of the third elongated hole. The fourth elongated hole extends from the first end thereof in a direction in which the tray is swung from the first position to the second position. The first shaft and the second shaft are respectively located at the second end of the first elongated hole and the second end of the fourth elongated hole in a state in which the tray is located at the first position. The first shaft and the second shaft are respectively located at the second end of the first elongated hole and the first end of the third elongated hole in a state in which the tray is located at the second position. The first shaft and the second shaft are respectively located at the first end of the first elongated hole and the second end of the third elongated hole in a state in which the tray is located at the third position. The first shaft and the second shaft are respectively located at the second end of the second elongated hole and the second end of the third elongated hole in a state in which the tray is located at the fourth position.

In another aspect of the disclosure, a sheet conveyor includes: a body defining therein a conveyance path through which a sheet is conveyed; a tray supported by the body and configured to support the sheet to be conveyed along the conveyance path, wherein the tray is configured to pivot, relative to the body, between a first position and a second position about a first axis and between a third position and a fourth position about a second axis, the first axis and the second axis being located at different positions relative to the tray; and a guide configured to guide the tray to move between the second position and the third position, such that the tray moves from the first position to the fourth position via the second position and the third position.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Figure 1:
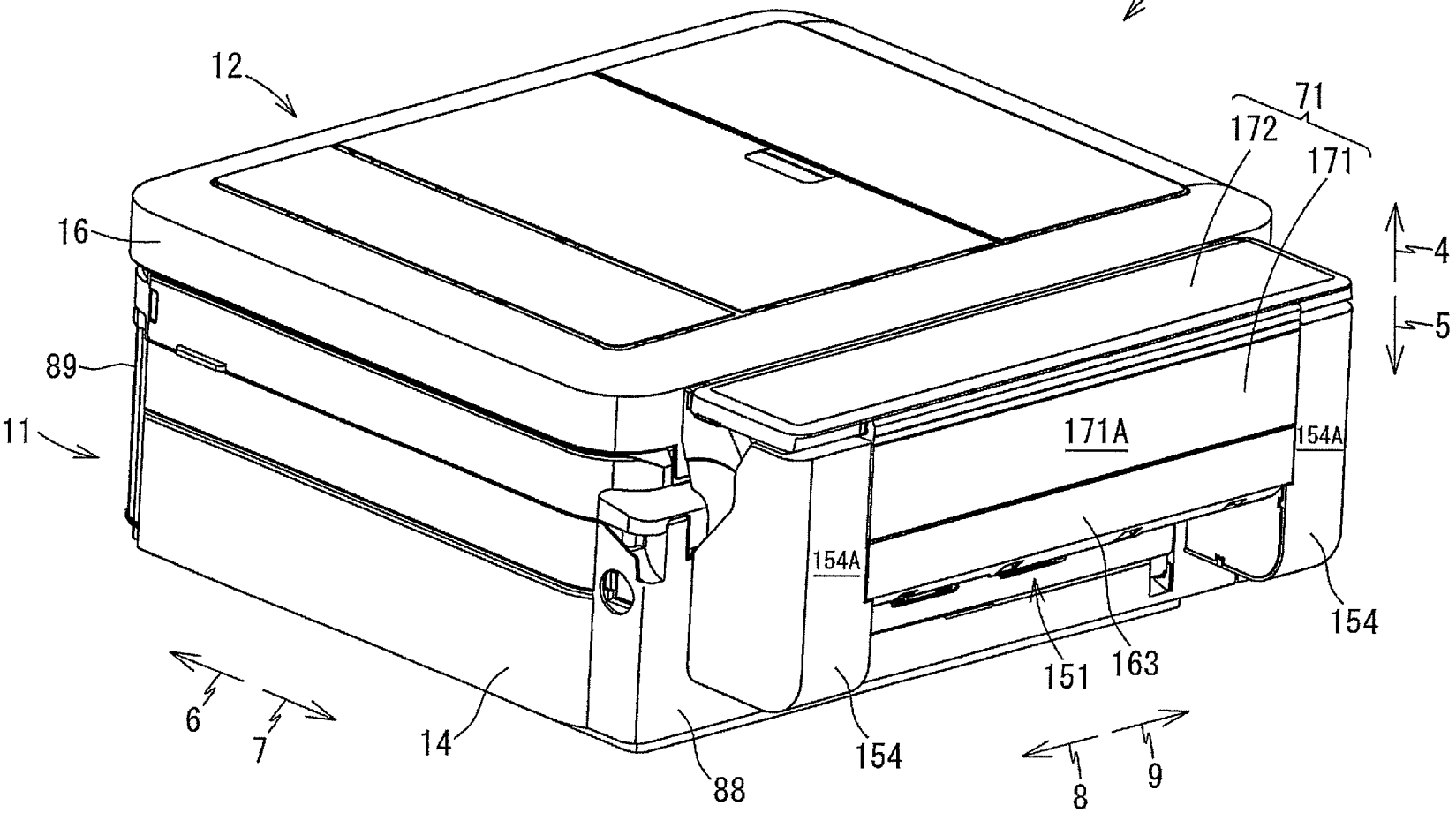
FIG. 1 is an external perspective view of a multi-function peripheral (MFP) in a state in which a first tray is located at a first position, and a second tray is located at a fifth position.

Hereinafter, there will be described a multi-function peripheral (MFP) 10 according to one embodiment by reference to the drawings. It is to be understood that the following embodiment is described only by way of example, and the disclosure may be otherwise embodied with various modifications without departing from the scope and spirit of the disclosure. In the following explanation, an up direction 4 and a down direction 5 are defined with respect to the MFP 10 being in a usable state. Also, a front direction 6 and a rear direction 7 are defined by defining a surface of the MFP 10 on which a support member 151 and a bypass tray 71 are provided, as a rear surface of the MFP 10 (a rear surface 88). Also, a right direction 8 and a left direction 9 are defined in a state in which the MFP 10 is viewed from a front side of the MFP 10. The up direction 4 and the down direction 5 are opposite to each other. The front direction 6 and the rear direction 7 are opposite to each other. The right direction 8 and the left direction 9 are opposite to each other. The up direction 4, the front direction 6, and the right direction 8 are perpendicular to each other.

Overall Construction of MFP 10

As illustrated in FIG. 1, the MFP 10 has a generally rectangular parallelepiped shape. The MFP 10 includes: an ink-jet printing unit 11 (as one example of an image recording apparatus) that records an image on a sheet such as a recording sheet S (see FIG. 3); and a scanning unit 12 configured to read an image formed on a sheet. The MFP 10 has various functions such as a facsimile function and a printing function. While the printing unit 11 includes an ink-jet printing mechanism in this embodiment, the printing unit 11 may have an electronic photographic printing mechanism, for example.

Figure 3:
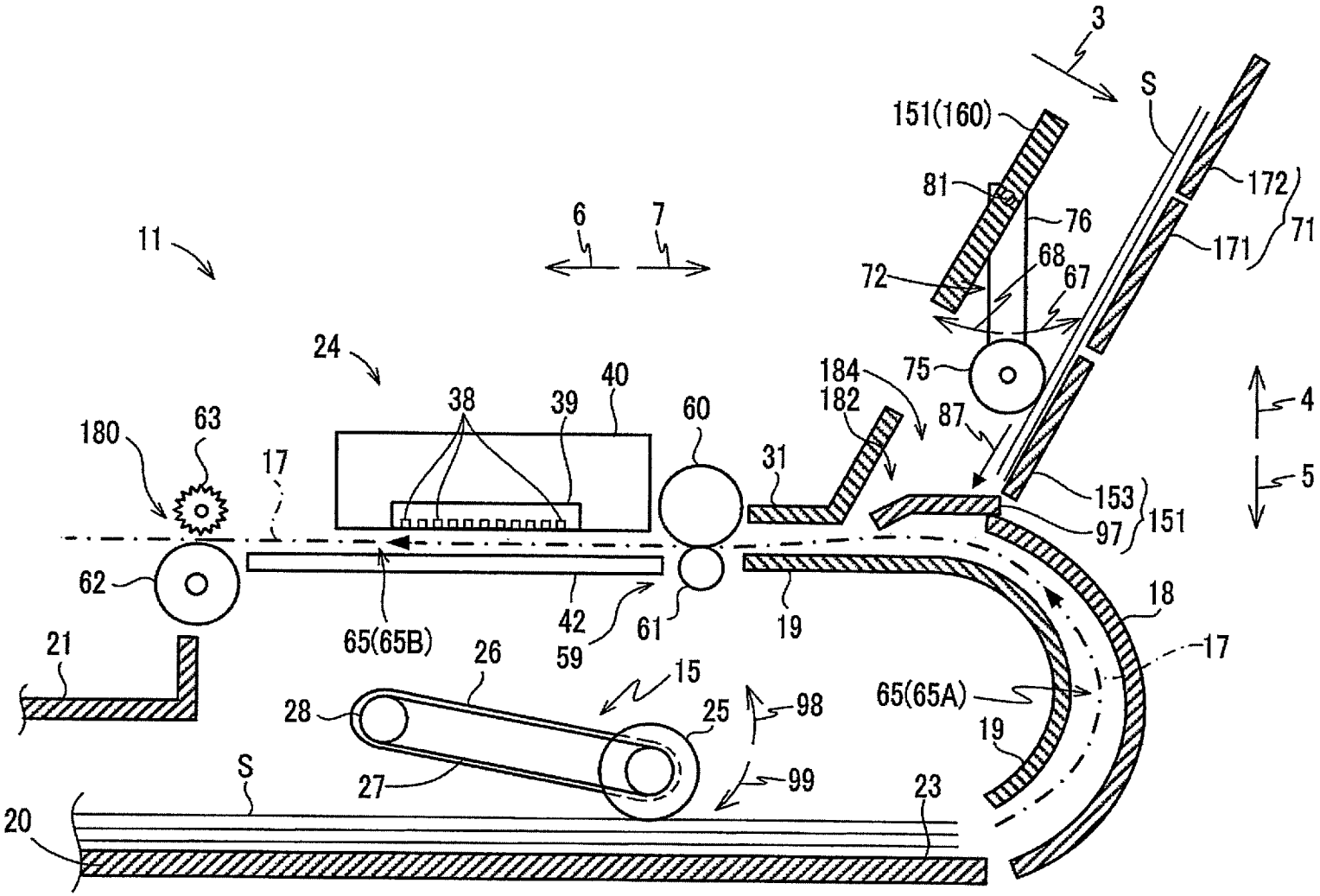
FIG. 3 is an elevational view in vertical cross section schematically illustrating an internal structure of a printing unit in a state in which the first tray is located at a second position, and the second tray is located at the sixth position.

The printing unit 11 includes a sheet conveyor, a supply tray 20 (see FIG. 3), a sheet supplier 15 (see FIG. 3), a sheet supplier 72 (see FIG. 3), and an image recorder 24 (see FIG. 3).

The sheet conveyor includes: a housing 14 having a conveyance path 65 (see FIG. 3) formed therein; the support member 151, the bypass tray 71, a first conveying roller pair 59 (see FIG. 3), and a second conveying roller pair 180 (see FIG. 3). Each of the housing 14 and the support member 151 is one example of a body.

As illustrated in FIG. 1, the housing 14 has an opening 184 formed in the rear surface 88. The support member 151 is mounted on the rear surface 88. The bypass tray 71 is provided for supporting the recording sheet S and supported by the support member 151. The first conveying roller pair 59 and the second conveying roller pair 180 illustrated in FIG. 3 convey the recording sheet S along the conveyance path 65.

As illustrated in FIG. 3, the supply tray 20 can store the recording sheets S of various sizes. The supply tray 20 is insertable in the rear direction 7 and removable in the front direction 6 through an opening, not illustrated, formed in a front surface 89 of the housing 14.

The sheet supplier 15 supplies the recording sheet S from the supply tray 20 to the conveyance path 65. The sheet supplier 72 supplies the recording sheet S from the bypass tray 71 to the conveyance path 65. The image recorder 24 records an image on the recording sheet S conveyed along the conveyance path 65.

The sheet supplier 15, the image recorder 24, the first conveying roller pair 59, and the second conveying roller pair 180 are arranged in the housing 14.

As illustrated in FIG. 1, the scanning unit 12 is provided on the printing unit 11. Dimensions of a housing 16 of the scanning unit 12 in the front and rear directions 6, 7 and the right and left directions 8, 9 are substantially equal to those of the housing 14 of the printing unit 11 in the front and rear directions 6, 7 and the right and left directions 8, 9, respectively. Thus, the housing 14 of the printing unit 11 and the housing 16 of the scanning unit 12 form the generally rectangular parallelepiped shape of the MFP 10 as a whole. The scanning unit 12 is a flatbed scanner. It is noted that a construction of the flatbed scanner is well known, and a detailed explanation of which is dispensed with.

Supply Tray 20

The supply tray 20 illustrated in FIG. 3 is shaped like a box that opens in its upper side. The length of the supply tray 20 in the up and down directions 4, 5 is shorter than each of the length thereof in the front and rear directions 6, 7 and the length thereof in the right and left directions 8, 9. An output tray 21 is provided above the supply tray 20. The supply tray 20 has a support surface 23 for supporting various sizes of the recording sheets S stacked on each other. Examples of the sizes include the A4 size and the L size.

Sheet Supplier 15

As illustrated in FIG. 3, the sheet supplier 15 includes a supply roller 25, a supply arm 26, and a drive-power transmitting mechanism 27. The sheet supplier 15 is provided over the support surface 23 of the supply tray 20. The supply roller 25 is rotatably supported at a distal end portion of the supply arm 26. The supply arm 26 is pivotable in directions indicated by arrows 98, 99 about a pivot shaft 28 provided on a basal end portion of the supply arm 26. Thus, the supply roller 25 is contactable with the support surface 23 of the supply tray 20. When the supply tray 20 storing the recording sheets S are mounted in the housing 14, the supply roller 25 contacts an uppermost one of the recording sheets S stored in the supply tray 20.

The supply roller 25 receives driving power transmitted from a motor, not illustrated, by the drive-power transmitting mechanism 27. The drive-power transmitting mechanism 27 is constituted by an endless belt that transmits rotation transmitted to the pivot shaft 28, to a shaft of the supply roller 25. The supply roller 25 is rotated in the state in which the supply roller 25 is held in contact with the upper most one of the recording sheets S supported on the support surface 23 of the supply tray 20, so that the uppermost recording sheet S is supplied to the conveyance path 65. It is noted that the drive-power transmitting mechanism 27 may be constituted by a gear train instead of the endless belt, for example.

Conveyance Path 65

As illustrated in FIG. 3, the conveyance path 65 is formed in the housing 14. The conveyance path 65 is curved from a rear end portion of the supply tray 20 so as to make an upward U-turn and extends substantially straight in the front direction 6 to the output tray 21. That is, the conveyance path 65 includes a curved path 65A and a straight path 65B.

The curved path 65A is defined by a guide member 18 and a guide member 19 opposed to and spaced apart from each other. The straight path 65B is defined by the image recorder 24 and a platen 42 opposed to and spaced apart from each other and by a guide member 31 and the guide member 19 opposed to and spaced apart from each other.

The recording sheet S supplied to the conveyance path 65 by the supply roller 25 is conveyed along the curved path 65A and the straight path 65B in a conveying direction 17 indicated by the one-dot chain line in FIG. 3.

The guide member 31 is provided downstream of the guide member 18 in the conveying direction 17. The guide member 31 also defines a portion of a bypass path 182 which will be described later.

First Conveying Roller Pair 59 and Second Conveying Roller Pair 180

As illustrated in FIG. 3, the first conveying roller pair 59 is provided on the conveyance path 65 at a position located downstream of the guide member 31 in the conveying direction 17. The first conveying roller pair 59 includes a first conveying roller 60 and a pinch roller 61. The second conveying roller pair 180 is provided on the conveyance path 65 at a position located downstream of the first conveying roller pair 59 in the conveying direction 17. The second conveying roller pair 180 includes a second conveying roller 62 and a spur roller 63. The first conveying roller 60 and the second conveying roller 62 are rotated by rotation transmitted from the motor, not illustrated. Each of the first conveying roller 60 of the first conveying roller pair 59 and the second conveying roller 62 of the second conveying roller pair 180 is rotated in a state in which the recording sheet S is nipped between the corresponding rollers, so that the recording sheet S is conveyed along the conveyance path 65 in the conveying direction 17.

Image Recorder 24

As illustrated in FIG. 3, the image recorder 24 is provided on the conveyance path 65 between the first conveying roller pair 59 and the second conveying roller pair 180. The image recorder 24 includes a carriage 40 and a recording head 39.

The carriage 40 is supported by two guide rails, not illustrated, which are spaced apart from each other in the front and rear directions 6, 7, with the recording head 39 interposed therebetween. The carriage 40 is reciprocable in the right and left directions 8, 9 perpendicular to the sheet surface of FIG. 3. One of the two guide rails is provided with a well-known belt mechanism. The carriage 40 is coupled to an endless belt of the belt mechanism and reciprocated by rotation of the endless belt along the two guide rails in the right and left directions 8, 9.

The recording head 39 is mounted on the carriage 40. A lower surface of the recording head 39 has a multiplicity of nozzles 38. Ink is supplied to the recording head 39 from ink cartridges, not illustrated. The recording head 39 selectively ejects fine droplets of the ink from the nozzles 38. During reciprocation of the carriage 40 in the right and left directions 8, 9, the recording head 39 ejects the ink onto the recording sheet S conveyed along the conveyance path 65 and supported on the platen 42. The ejected ink adheres to the recording sheet S, so that an image is recorded on the recording sheet S.

Support Member 151

Figure 2:
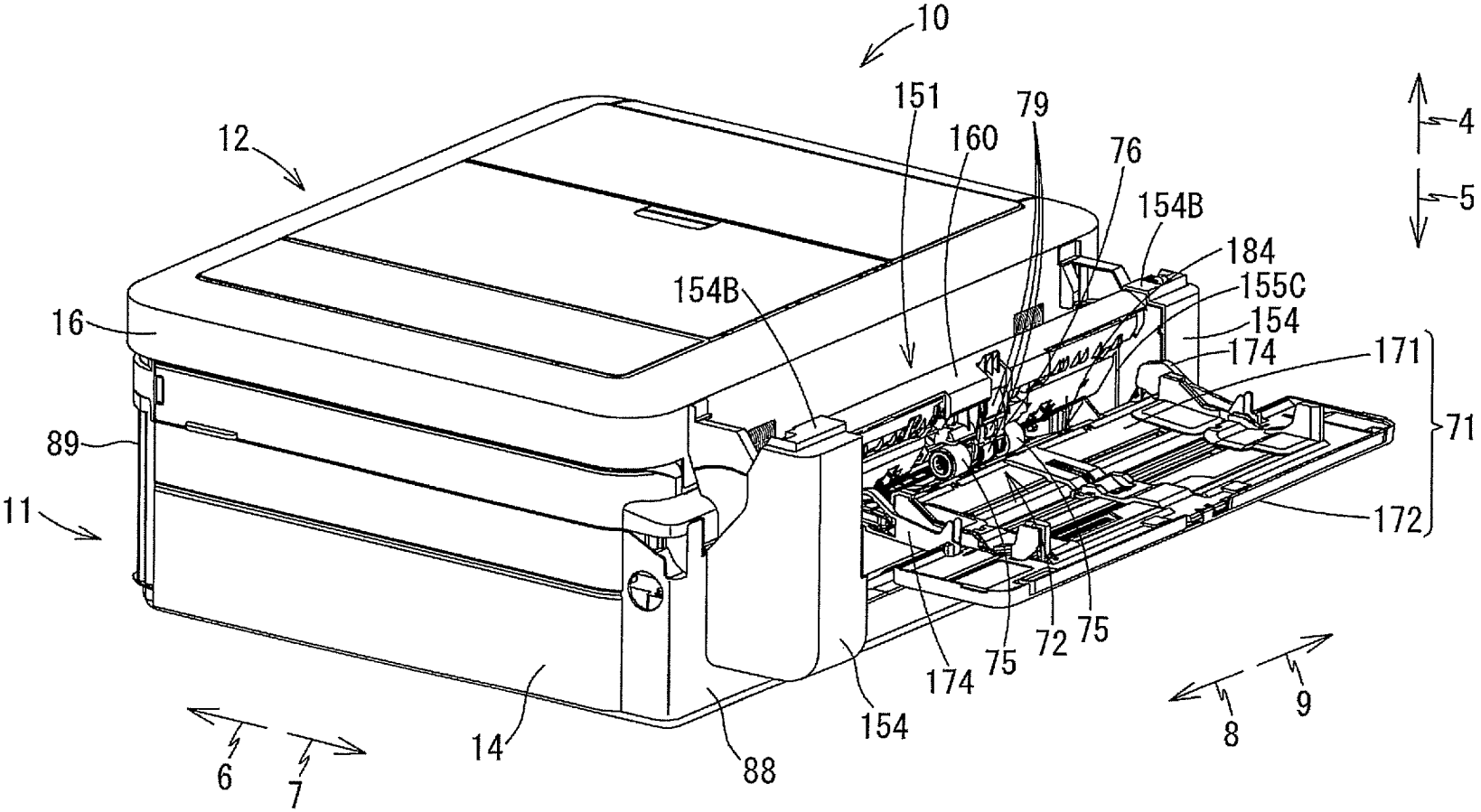
FIG. 2 is an external perspective view of the MFP in a state in which the first tray is located at a fourth position, and the second tray is located at a sixth position.

As illustrated in FIGS. 1 and 2, the support member 151 is mounted on the rear surface 88 of the printing unit 11. The support member 151 includes: a body 152 (see FIG. 4); a support plate 153 (see FIG. 3) for supporting the recording sheet S with the bypass tray 71 which will be described below; an arm supporter 160 (see FIGS. 2 and 3) for supporting a supply arm 76 of the sheet supplier 72, which will be described below, such that the supply arm 76 is pivotable; and a pair of covers 154 (see FIGS. 1 and 2).

Figure 4:
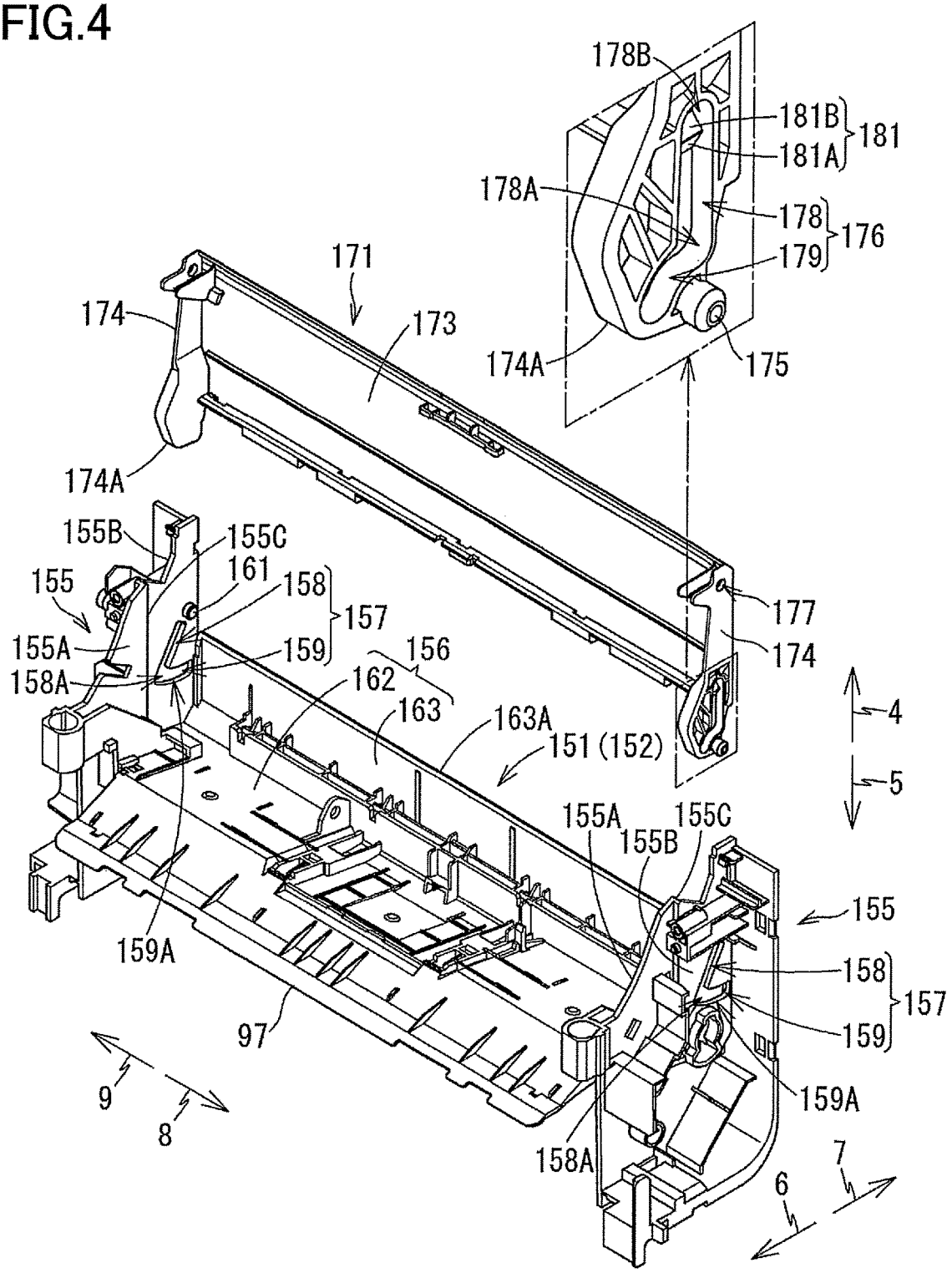
FIG. 4 is an exploded perspective view of the first tray and a body of a support member.

As illustrated in FIG. 4, the body 152 includes: a pair of side members 155 spaced apart from each other in the right and left directions 8, 9; a bottom member 156 connecting between the pair of side members 155; and a guide member 97 extending from a front end portion of the bottom member 156 substantially in the front direction 6.

Each of the pair of side members 155 is provided with a protrusion 161 (as one example of a first shaft) and formed with a guide 157 (as one example of a second guide).

The protrusion 161 provided on the right side member 155 of the pair of side members 155 protrudes in the left direction 9 from a left surface, namely, an inner surface 155A of the right side member 155. The protrusion 161 provided on the left side member 155 of the pair of side members 155 protrudes in the right direction 8 from a right surface (an inner surface 155A) of the left side member 155. The protrusions 161 are located on the same imaginary line extending in the right and left directions 8, 9. It is noted that FIG. 4 does not illustrate the protrusion 161 provided on the right side member 155 because the protrusion 161 is hidden by the side member 155.

Each guide 157 is formed below a corresponding one of the protrusions 161. The guide 157 is an elongated hole formed through the side member 155 from the inner surface 155A to an outer surface 155B that is a back surface of the side member 155 from the inner surface 155A. The guide 157 has an elongated hole 158 (as one example of a third elongated hole) and an elongated hole 159 (as one example of a fourth elongated hole). The elongated hole 158 extends obliquely in the front direction 6 and the down direction 5 from a position near the protrusion 161. The elongated hole 159 has an end 159A (as one example of a first end of the fourth elongated hole) continued from a lower end 158A of the elongated hole 158 (as one example of a first end of the third elongated hole). The elongated hole 159 extends from the end 159A and is curved in an arc shape centered about the protrusion 161. It is noted that the guide 157 may not be formed through the side member 155 and may be a groove formed in the inner surface 155A, for example.

Each of the pair of side members 155 is bent in front of the guide 157. With this construction, each of the pair of side members 155 has a surface 155C (as one example of a first restrainer). The surface 155C faces in the rear direction 7.

A right end of the bottom member 156 is connected to the right side member 155. A left end of the bottom member 156 is connected to the left side member 155. The bottom member 156 includes a first plate 162 extending in the front and rear directions 6, 7 and the right and left directions 8, 9, and a second plate 163 extending in the up direction 4 from a rear end of the first plate 162. The second plate 163 is provided under the bypass tray 71.

The guide member 97 extends substantially in the front direction 6 from a front end of the first plate 162. A lower edge of the recording sheet S (i.e., a downstream edge thereof in a sheet supply direction 87) contacts a rear portion of the guide member 97 when the recording sheet S is placed on the support plate 153 and the bypass tray 71 (see FIG. 3). A front portion of the guide member 97 defines, in cooperation with the guide member 31, the bypass path 182, which will be described below (see FIG. 3).

The support plate 153 illustrated in FIG. 3 extends in a direction perpendicular to the sheet surface of FIG. 3, that is, the support plate 153 extends in the right and left directions 8, 9. The support plate 153 is supported by the bottom member 156 illustrated in FIG. 4. It is noted that FIG. 4 does not illustrate the support plate 153. The support plate 153 may be supported by the pair of side members 155. The support plate 153 supports a downstream portion of the recording sheet S supported on the bypass tray 71 in the sheet supply direction 87 (see FIG. 3). The bypass tray 71 supports the other portion of the recording sheet S.

As illustrated in FIG. 2, the arm supporter 160 extends in the right and left directions 8, 9. Right and left ends of the arm supporter 160 are fitted in upper end portions of the respective side members 155, for example. As illustrated in FIG. 3, the arm supporter 160 is provided above the support plate 153 and the bypass tray 71 so as to be opposed to the support plate 153 and the bypass tray 71. As illustrated in FIGS. 2 and 3, the arm supporter 160 supports the supply arm 76 at its central portion in the right and left directions 8, 9 such that the supply arm 76 is pivotable.

The pair of covers 154 illustrated in FIGS. 1 and 2 cover the outer surfaces 155B of the respective side members 155.

Bypass Path 182

As illustrated in FIG. 2, the rear surface 88 of the housing 14 has the opening 184. The support member 151 is mounted on the rear surface 88 so as to define the opening 184. As illustrated in FIG. 3, the bypass path 182 is formed in the housing 14 so as to extend from the opening 184 to the first conveying roller pair 59.

As illustrated in FIG. 3, the bypass path 182 is formed in the housing 14 so as to obliquely extend from the opening 184 in the front direction 6 and the down direction 5. The bypass path 182 is defined by the guide member 31 and the guide member 97. The bypass path 182 is located above the conveyance path 65.

The recording sheet S supported on the bypass tray 71 and the support plate 153 is supplied to the straight path 65B of the conveyance path 65 while being guided to a front lower side along the bypass path 182. The recording sheet S is conveyed along the straight path 65B by the first conveying roller pair 59. The recording sheet S is discharged onto the output tray 21 by the second conveying roller pair 180 after image recording is performed on the recording sheet S by the image recorder 24.

Bypass Tray 71

The bypass tray 71 illustrated in FIGS. 1 and 2 is supported by the support member 151. As illustrated in FIGS. 1 and 2, the bypass tray 71 includes a first tray 171 (as one example of a tray) and a second tray 172. The first tray 171 is pivotably and slidably supported by the support member 151. The second tray 172 is pivotably supported by the first tray 171. As illustrated in FIG. 3, the first tray 171 and the second tray 172 can support, in coopearation with the support plate 153 of the support member 151, the recording sheets S stacked on each other.

As illustrated in FIG. 4, the first tray 171 is shaped like a generally planar plate. The first tray 171 includes: a support plate 173 for supporting the recording sheet S; and a pair of side plates 174 provided on a right end portion and a left end portion of the support plate 173. Each of the side plates 174 is provided with a protrusion 175 (as one example of a second shaft) and has a guide 176 (as one example of a first guide) and a through hole 177. The protrusion 175 is provided on one end portion of the side plate 174 in its longitudinal direction. This one end portion is a basal end portion of the first tray 171. The through hole 177 is formed through the other end portion of the side plate 174 in the longitudinal direction. The other end portion is a free end portion of the first tray 171. It is noted that FIG. 4 does not illustrate the protrusion 175 and the guide 176 provided on and in the left side plate 174 because the protrusion 175 and the guide 176 are hidden by the side plate 174.

The protrusion 175 provided on the right side plate 174 protrudes in the right direction 8. The protrusion 175 provided on the left side plate 174 protrudes in the left direction 9. These protrusions 175 are located on the same imaginary line extending in the right and left directions 8, 9. Each of the protrusions 175 is inserted in a corresponding one of the guides 157 formed in the support member 151 and guided along the guide 157.

Each of the guides 176 is a groove formed in an outer surface of the support plate 173. Here, the outer surface includes a right surface of the right side plate 174 and a left surface of the left side plate 174. The protrusions 161 provided on the support member 151 are respectively inserted into the guides 176. The protrusions 161 are guided along the respective guides 176.

The guide 176 has a groove 178 (as one example of a first elongated hole) and a groove 179 (as one example of a second elongated hole). The groove 178 extends toward the protrusion 175 from a position located between the protrusion 175 and the through hole 177. The groove 179 has an end 179A (as one example of a first end of the second elongated hole) continued from an end 178 A of the groove 178 nearer to the protrusion 175 (as one example of a first end of the first elongated hole). The groove 179 extends from the end 179A and is curved in an arc shape centered about the protrusion 175. It is noted that the guide 176 may be formed through the support plate 173 from the outer surface to a back surface of the support plate 173 from the outer surface 173 A.

As illustrated in FIG. 4, protrusions 181 are provided on bottom surfaces of the respective grooves 178. Specifically, the protrusion 181 provided on the right side plate 174 protrudes in the right direction 8, and the protrusion 181 provided on the left side plate 174 protrudes in the left direction 9. Each of the protrusions 181 is contactable with the protrusion 161 inserted in a corresponding one of the guides 176. That is, the protrusion 181 protrudes toward a guide path for guiding the protrusion 161.

The protrusion 181 is provided between the end 178A of the groove 178 near the protrusion 175 and an end 178B of the groove 178 near the through hole 177 (as one example of a second end of the first elongated hole). The protrusion 181 has a first inclined surface 181A and a second inclined surface 181B. The first inclined surface 181A is inclined in a protruding direction of the protrusion 181 from an end of the first inclined surface 181A near the end 178A toward an end of the first inclined surface 181A near the end 178B. The second inclined surface 181B is continued from the first inclined surface 181A and inclined in a direction reverse to the protruding direction from an end of the second inclined surface 181B near the end 178A toward an end of the second inclined surface 181B.

The protrusion 161 is guided from the end 178A to the end 178B and brought into contact with the first inclined surface 181A. When a force having a magnitude greater than or equal to a certain magnitude is applied from the protrusion 161 to the protrusion 181 in this state, the protrusion 181 is moved in a direction away from the guide path. This movement causes the side plate 174 of the first tray 171 to be bent due to its elasticity. As a result, the protrusion 161 is guided along the first inclined surface 181A, moved over the protrusion 181, and reaches the end 178B. When guided from the end 178B to the end 178A, the protrusion 161 is brought into contact with the second inclined surface 181B. When a force having a magnitude greater than or equal to a certain magnitude is applied from the protrusion 161 to the protrusion 181 in this state, the protrusion 181 is moved in the direction away from the guide path. This movement causes the side plate 174 of the first tray 171 to be bent due to its elasticity. As a result, the protrusion 161 is guided along the second inclined surface 181B, moved over the protrusion 181, and reaches the end 178A.

In view of the above, when a force having a magnitude greater than or equal to the certain magnitude is applied to the protrusion 161, the protrusion 161 is movable between the end 178A and the end 178B. When a force having a magnitude less than the certain magnitude is applied to the protrusion 161, the protrusion 181 restrains movement of the protrusion 161 along the groove 178.

As illustrated in FIGS. 1 and 2, the second tray 172 is shaped like a generally planar plate. A pair of protrusions 164 (see FIG. 5A) are provided respectively on right and left end portions the second tray 172. The right protrusion 164 protrudes in the right direction 8. The left protrusion 164 protrudes in the left direction 9. The protrusions 164 are located on the same imaginary line extending in the right and left directions 8, 9. The protrusions 164 are inserted into the respective through holes 177 formed in the first tray 171 (see FIG. 4). With this construction, the second tray 172 is pivotably supported by the first tray 171.

Sheet Supplier 72

As illustrated in FIGS. 2 and 3, the sheet supplier 72 is supported by the arm supporter 160 of the support member 151. In the present embodiment, the sheet supplier 72 is opposed to the support plate 153 of the support member 151 and a sheet support surface of the bypass tray 71 for supporting the recording sheet S. Specifically, one end portion of the sheet supplier 72 (specifically, a supply roller 75 which will be described below and a free end portion of the supply arm 76) is opposed to the support plate 153, and the other portion of the sheet supplier 72 is opposed to the bypass tray 71.

The sheet supplier 72 includes the supply roller 75, the supply arm 76 (as one example of an arm), and a drive-power transmitting mechanism 79. The supply roller 75 is rotatably supported at a distal end portion of the supply arm 76. A basal end portion of the supply arm 76 is supported by the arm supporter 160 of the support member 151 such that the supply arm 76 is pivotable about a pivot shaft 81 in directions indicated by arrows 67, 68. Thus, the supply roller 75 is contactable with an uppermost one of the recording sheets S stacked on a support surface of the support plate 153. When the recording sheets S are placed on the bypass tray 71 and the support plate 153, the supply roller 75 contacts an uppermost one of the recording sheets S.

The supply roller 75 receives the driving power transmitted from the motor, not illustrated, by the drive-power transmitting mechanism 79. The drive-power transmitting mechanism 79 is constituted by a gear train that transmits rotation transmitted to the pivot shaft 81, to a shaft of the supply roller 75. The supply roller 75 is rotated in the state in which the supply roller 75 is held in contact with the upper most one of the recording sheets S supported on the support plate 153 and the bypass tray 71, so that the uppermost recording sheet S is supplied toward the bypass path 182 and the conveyance path 65 in the sheet supply direction 87. It is noted that the drive-power transmitting mechanism 27 may be constituted by an endless belt instead of the gear train, for example.

It is noted that the entire sheet supplier 72 may be opposed to the bypass tray 71. In this case, the supply roller 75 is movable to and away from not the support plate 153 but the sheet support surface of the bypass tray 71. Also, the supply roller 75 may be moved to and away from the sheet support surface of the bypass tray 71. In this case, the support member 151 may not include the support plate 153.

Pivotal Movement and Sliding of Bypass Tray 71

The bypass tray 71 is swung and slid with respect to the housing 14 and the support member 151. The first tray 171 is swung and slid to move selectively to one of a first position illustrated in FIGS. 5A and 5B, a second position illustrated in FIGS. 6A and 6B, a third position illustrated in FIGS. 7A and 7B, and a fourth position illustrated in FIGS. 8A and 8B in order. The second tray 172 is swung to move selectively to one of a fifth position illustrated in FIGS. 5A and 5B and a sixth position illustrated in FIGS. 6A-8B.

Figure 5B:
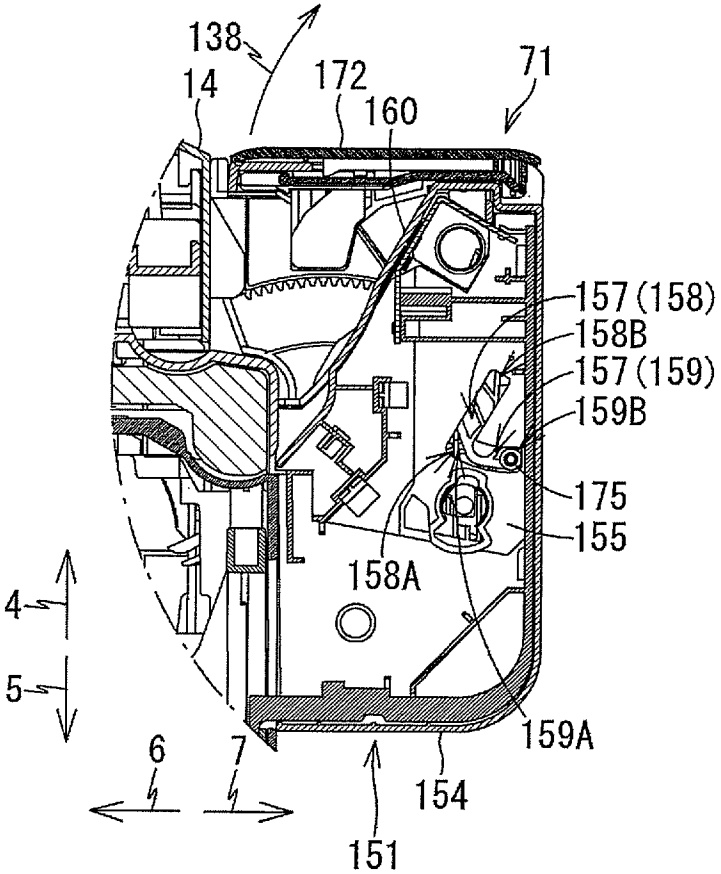
FIGS. 5A and 5B are elevational views in vertical cross section each illustrating the bypass tray, the support member, and components near the bypass tray and the support member in the state in which the first tray is located at the first position, and the second tray is located at the fifth position.
Figure 5A:
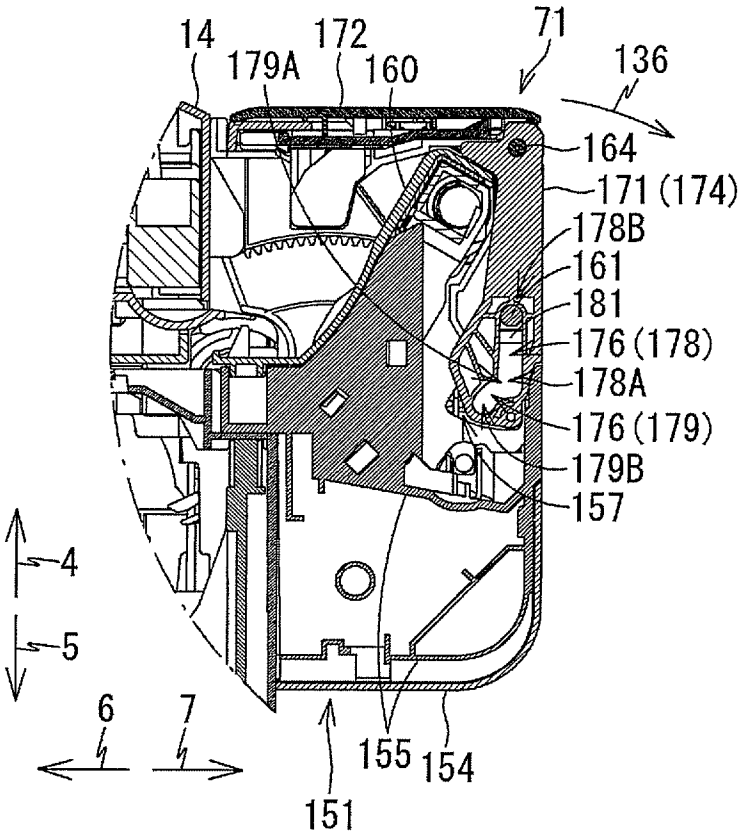

When the recording sheet S is not supported on the bypass tray 71, as illustrated in FIGS. 5A and 5B, the bypass tray 71 does not protrude with respect to the housing 14 and the support member 151. As a result, the MFP 10 occupies a smaller space.

As illustrated in FIGS. 1, 5A, and 5B, when located at the first position, the first tray 171 extends generally in the up and down directions 4, 5. That is, the first tray 171 located at the first position stands along the rear surface 88 of the housing 14. In this state, a surface 171A of the first tray 171 which faces in the rear direction 7 is flush with surfaces 154A of the covers 154 which face in the rear direction 7.

When the first tray 171 is located at the first position, the second tray 172 can be located at the fifth position. As illustrated in FIGS. 1, 5A, and 5B, when the first tray 171 is located at the first position, and the second tray 172 is located at the fifth position, the right and left end portions of the second tray 172 are supported by upper surfaces 154B of the respective covers 154 (see FIG. 2).

As illustrated in FIG. 5A, when the first tray 171 is located at the first position, each protrusion 161 is located at the end 178B of the groove 178. As illustrated in FIG. 5B, when the first tray 171 is located at the first position, each protrusion 175 is located at an end 159B of the elongated hole 159 which is farthest from the end 159A in the elongated hole 159. This end 159B is one example of a second end of the fourth elongated hole. As a result, a surface defining the groove 178 is in contact with the protrusion 161, and the protrusion 175 is in contact with a surface defining the elongated hole 159, whereby the first tray 171 is supported by the support member 151.

In this state, the protrusion 175 is movable along the elongated hole 159 in a direction directed from the end 159B toward the end 159A but not movable in a direction opposite to the direction directed from the end 159B toward the end 159A. That is, the first tray 171 located at the first position is pivotable about the protrusions 161 in a direction indicated by an arrow 136 (see FIG. 5A). That is, when the first tray 171 is located at the first position, a free end of the first tray 171 is located above a basal end of the first tray 171. The first tray 171 located at the first position is not pivotable in a direction reverse to the direction indicated by the arrow 136.

Figure 6B:
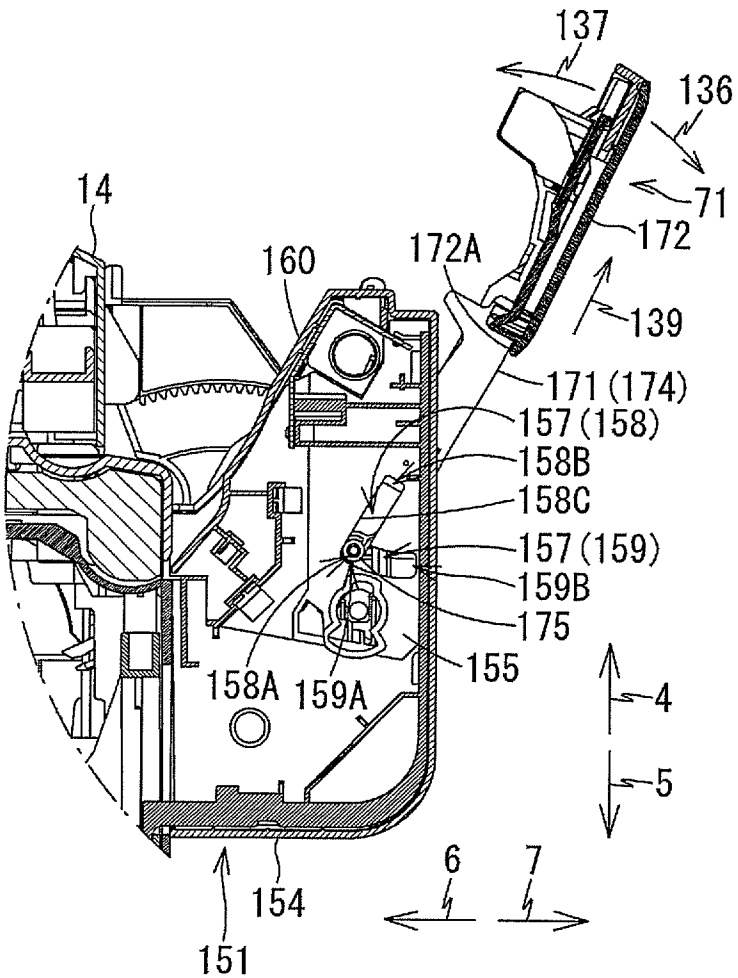
FIGS. 6A and 6B are elevational views in vertical cross section each illustrating the bypass tray, the support member, and the components near the bypass tray and the support member in the state in which the first tray is located at the second position, and the second tray is located at the sixth position.
Figure 6A:
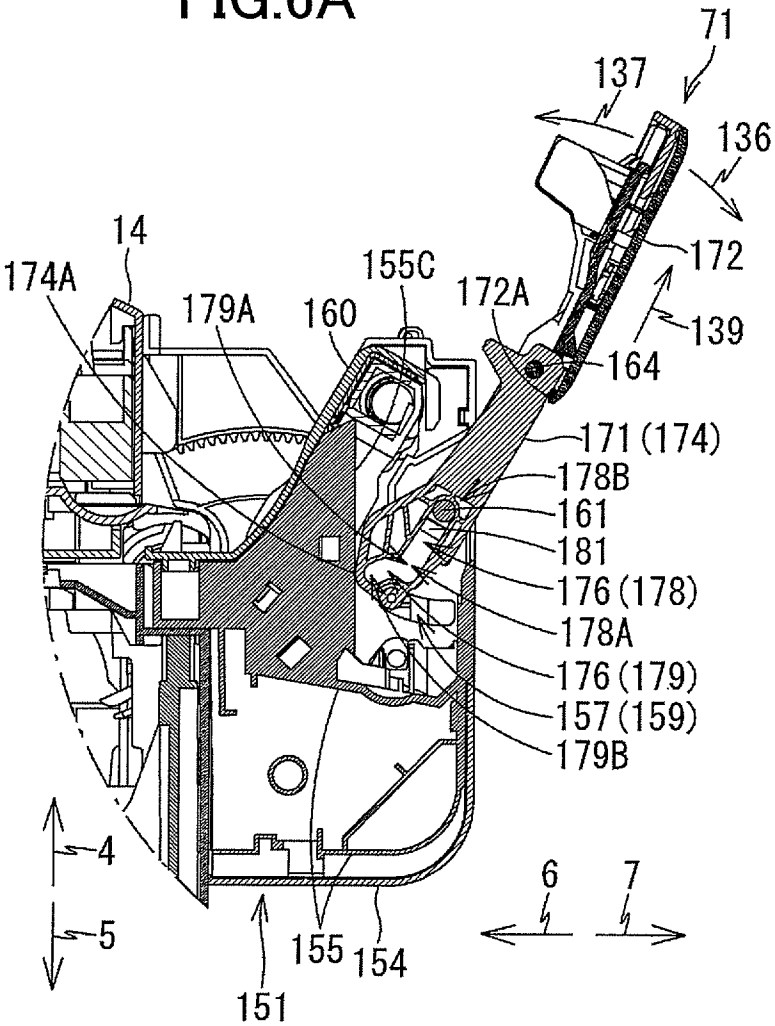

The first tray 171 is pivotable from the first position to the second position (see FIGS. 6A and 6B) in the direction indicated by the arrow 136. That is, each of the elongated holes 159 extends along a pivoting direction in which the first tray 171 is swung from the first position to the second position. The second tray 172 is pivotable from the fifth position to the sixth position (see FIGS. 6A and 6B) in a direction indicated by an arrow 138 (see FIG. 5B). As illustrated in FIGS. 6A and 6B, when the second tray 172 is located at the sixth position, a lower end portion 172A of the second tray 172 is held in contact with a rear portion of the first tray 171. This contact restrains further pivotal movement of the second tray 172 in the direction indicated by the arrow 138.

The first tray 171 located at the second position and the second tray 172 located at the sixth position extend in the rear direction 7 and the up direction 4. That is, the first tray 171 located at the second position and the second tray 172 located at the sixth position protrude from the housing 14 and the support member 151 in the rear direction 7 and the up direction 4. That is, the first tray 171 located at the second position and the second tray 172 located at the sixth position are inclined with respect to the rear surface 88 of the housing 14. The position of the free end of the first tray 171 located at the second position is farther from the housing 14 and the support member 151 than the position of the free end of the first tray 171 located at the first position.

As illustrated in FIG. 3, when the first tray 171 is located at the second position, and the second tray 172 is located at the sixth position, the first tray 171, the second tray 172, and the support plate 153 of the support member 151 are arranged in a generally straight line. As a result, the first tray 171 and the second tray 172 can support the recording sheet S in cooperation with the support plate 153.

As illustrated in FIG. 6A, as in the case where the first tray 171 is located at the first position, when the first tray 171 is located at the second position, each protrusion 161 is located at the end 178B of the corresponding groove 178.

As illustrated in FIG. 6B, when the first tray 171 is located at the second position, each protrusion 175 provided on the first tray 171 is located at the lower end 158A of the corresponding elongated hole 158. The elongated hole 158 has a surface 158C which faces in the rear direction 7 (as another example of the first restrainer). The protrusion 175 is in contact with this surface 158C from a rear side thereof. This contact restrains pivotal movement of the first tray 171 from the second position in the direction indicated by the arrow 136, i.e., in a direction away from the first position.

As illustrated in FIG. 6A, when the first tray 171 is located at the second position, lower end portions 174A of the respective side plates 174 of the first tray 171 are in contact with the surfaces 155C of the respective side members 155 of the support member 151 from a rear side thereof. Here, the lower end portions 174A are located on an opposite side of the protrusions 161 inserted in the first tray 171, from the free end of the first tray 171. With the construction described above, the pivotal movement of the first tray 171 from the second position in the direction indicated by the arrow 136 is restrained.

As illustrated in FIG. 6B, when the first tray 171 is located at the second position, each protrusion 175 is located at the lower end 158A of the corresponding elongated hole 158 (i.e., the end 159A of the corresponding elongated hole 159). Thus, the protrusion 175 is movable along the elongated hole 159 in a direction directed from the end 159A toward the end 159B. That is, the first tray 171 located at the second position is pivotable about the protrusion 161 in a direction indicated by an arrow 137 which is reverse to the direction indicated by the arrow 136. The first tray 171 is pivotable from the second position to the first position (see FIGS. 5A and 5B) in the direction indicated by the arrow 137.

As illustrated in FIGS. 6A and 6B, when the first tray 171 is located at the second position, the elongated hole 158 (see FIG. 6B) and the groove 178 (see FIG. 6A) are parallel with each other. Also, as described above, the protrusion 161 is located at the end 178B of the groove 178, and the protrusion 175 is located at the lower end 158A of the elongated hole 158. As a result, the first tray 171 is slidable from the second position toward the third position illustrated in FIGS. 7A and 7B in a direction indicated by an arrow 139 by movement of the protrusion 161 from the end 178B to the end 178A along the groove 178 and movement of the protrusion 175 from the lower end 158A to an upper end 158B of the elongated hole 158 (as one example of a second end of the third elongated hole) along the elongated hole 158. That is, each of the groove 178 and the elongated hole 158 extends in a direction in which the first tray 171 is slid. This direction may be hereinafter referred to as "slide direction", and this direction coincides with the direction indicated by the arrow 139, a direction indicated by the arrow 141 which will be described below, and a direction in which the first tray 171 is moved from the second position to the third position.

Figure 7B:
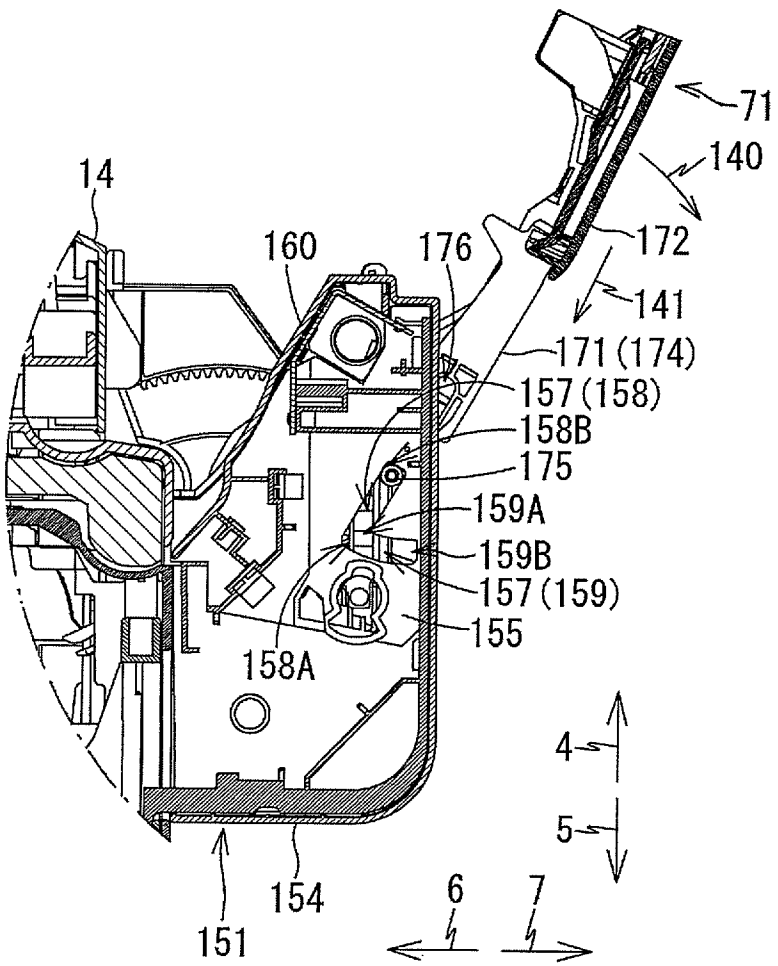
FIGS. 7A and 7B are elevational views in vertical cross section each illustrating the bypass tray, the support member, and the components near the bypass tray and the support member in a state in which the first tray is located at a third position, and the second tray is located at the sixth position.
Figure 7A:
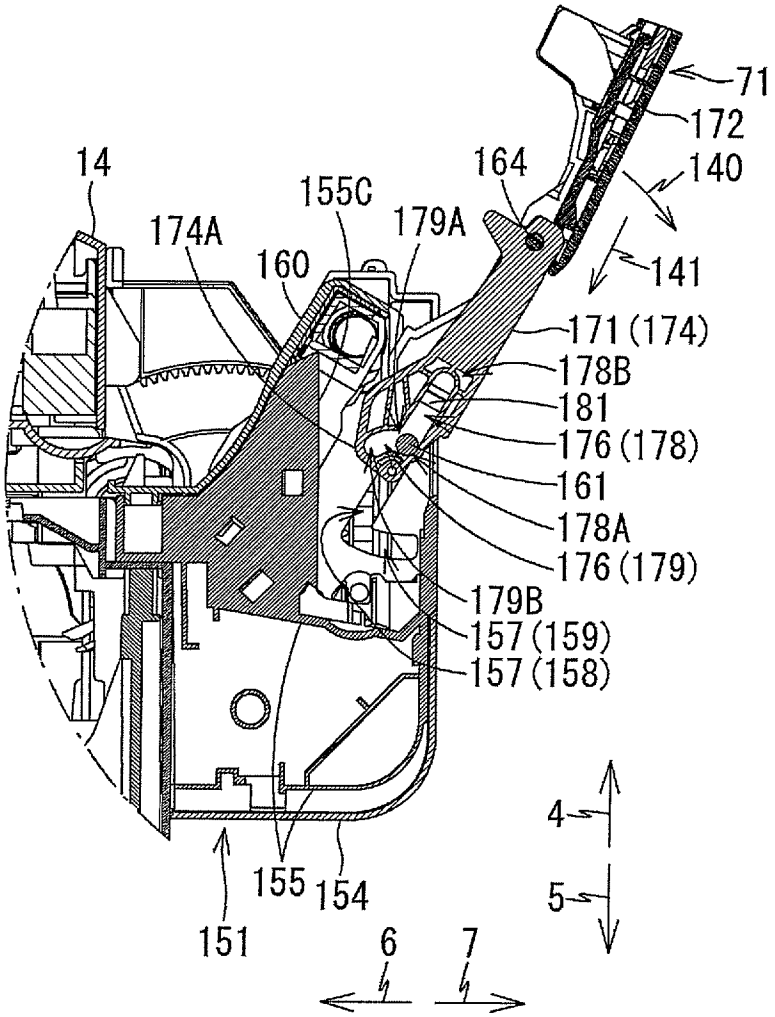

As illustrated in FIGS. 7A and 7B, when the first tray 171 is located at the third position, the elongated hole 158 (see FIG. 7B) and the groove 178 (see FIG. 7A) are parallel with each other. The protrusion 161 is located at the end 178A of the groove 178, and the protrusion 175 is located at the upper end 158B of the elongated hole 158. As a result, the first tray 171 is slidable from the third position toward the second position illustrated in FIGS. 6A and 6B in the direction indicated by the arrow 141 by movement of the protrusion 161 from the end 178A to the end 178B along the groove 178 and movement of the protrusion 175 from the upper end 158B to the lower end 158A along the elongated hole 158.

As illustrated in FIG. 7A, when the first tray 171 is located at the third position, the protrusion 161 is located at the end 179A of the groove 179 (i.e., the end 178A of the groove 178). Thus, the protrusion 161 is movable along the groove 179 in a direction directed from the end 179A toward an end 179B of the groove 179 (as one example of a second end of the second elongated hole). The end 179B is located farthest from the end 179A in the groove 179. That is, the first tray 171 is pivotable from the third position to the fourth position about the protrusions 175 in a direction indicated by an arrow 140. The first tray 171 located at the third position is not pivotable in a direction reverse to the direction indicated by the arrow 140.

The first tray 171 is pivotable from the third position to the fourth position (see FIGS. 8A and 8B) in the direction indicated by the arrow 140. That is, the groove 179 extends along a pivoting direction in which the first tray 171 is swung from the third position to the fourth position.

Figure 8A:
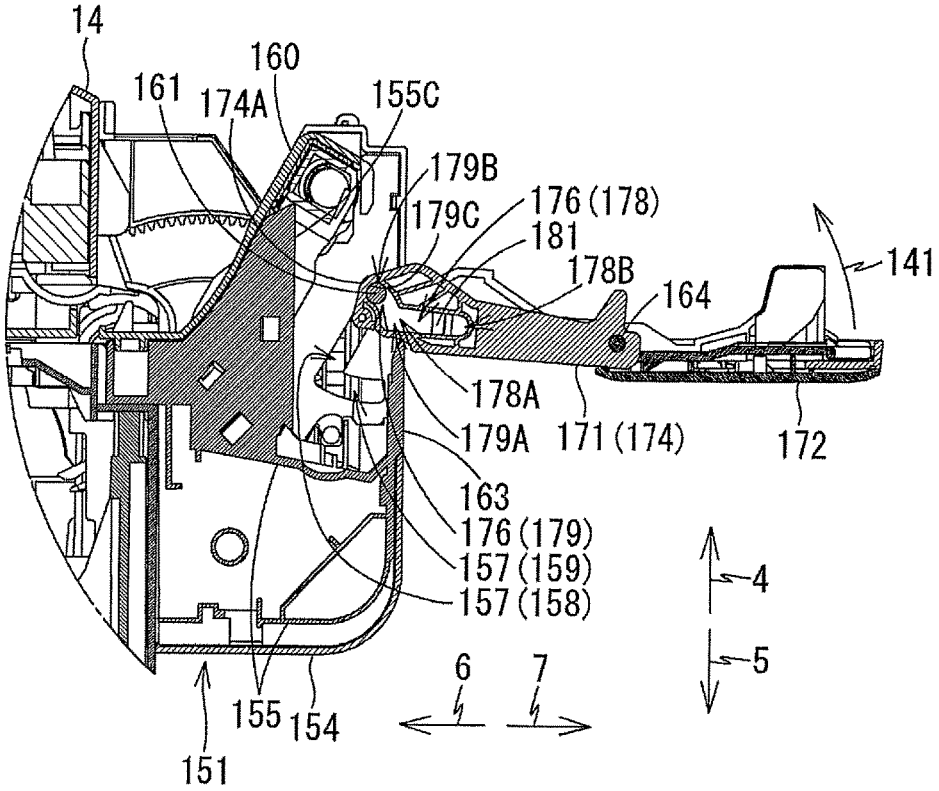
FIGS. 8A and 8B are elevational views in vertical cross section each illustrating the bypass tray, the support member, and the components near the bypass tray and the support member in the state in which the first tray is located at the fourth position, and the second tray is located at the sixth position.
Figure 8B:
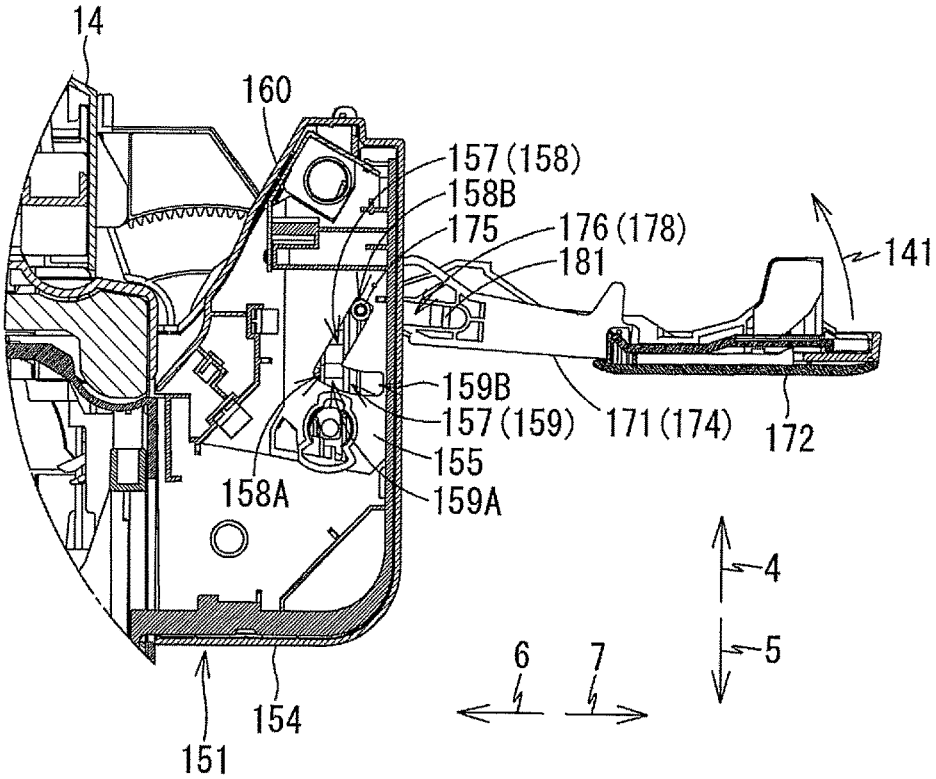

As illustrated in FIGS. 8A and 8B, when the first tray 171 is located at the fourth position, the first tray 171 extends substantially in the front and rear directions 6, 7 which are substantially perpendicular to the rear surface 88 of the housing 14. The position of the free end of the first tray 171 located at the fourth position is located farther from the housing 14 and the support member 151 than the position of the free end of the first tray 171 located at the third position.

As illustrated in FIG. 8B, as in the case where the first tray 171 is located at the third position, when the first tray 171 is located at the fourth position, the protrusion 175 is located at the upper end 158B of the elongated hole 158.

As illustrated in FIG. 8A, when the first tray 171 is located at the fourth position, the protrusion 161 is located at the end 179B of the groove 179. In this state, the protrusion 161 is in contact with a surface 179C defining the groove 179 from a lower side thereof. The surface 179C is one example of a second restrainer. This contact restrains pivotal movement of the first tray 171 from the fourth position in the direction indicated by the arrow 140, i.e., in a direction away from the third position (see FIGS. 7A and 7B).

Figure 9:
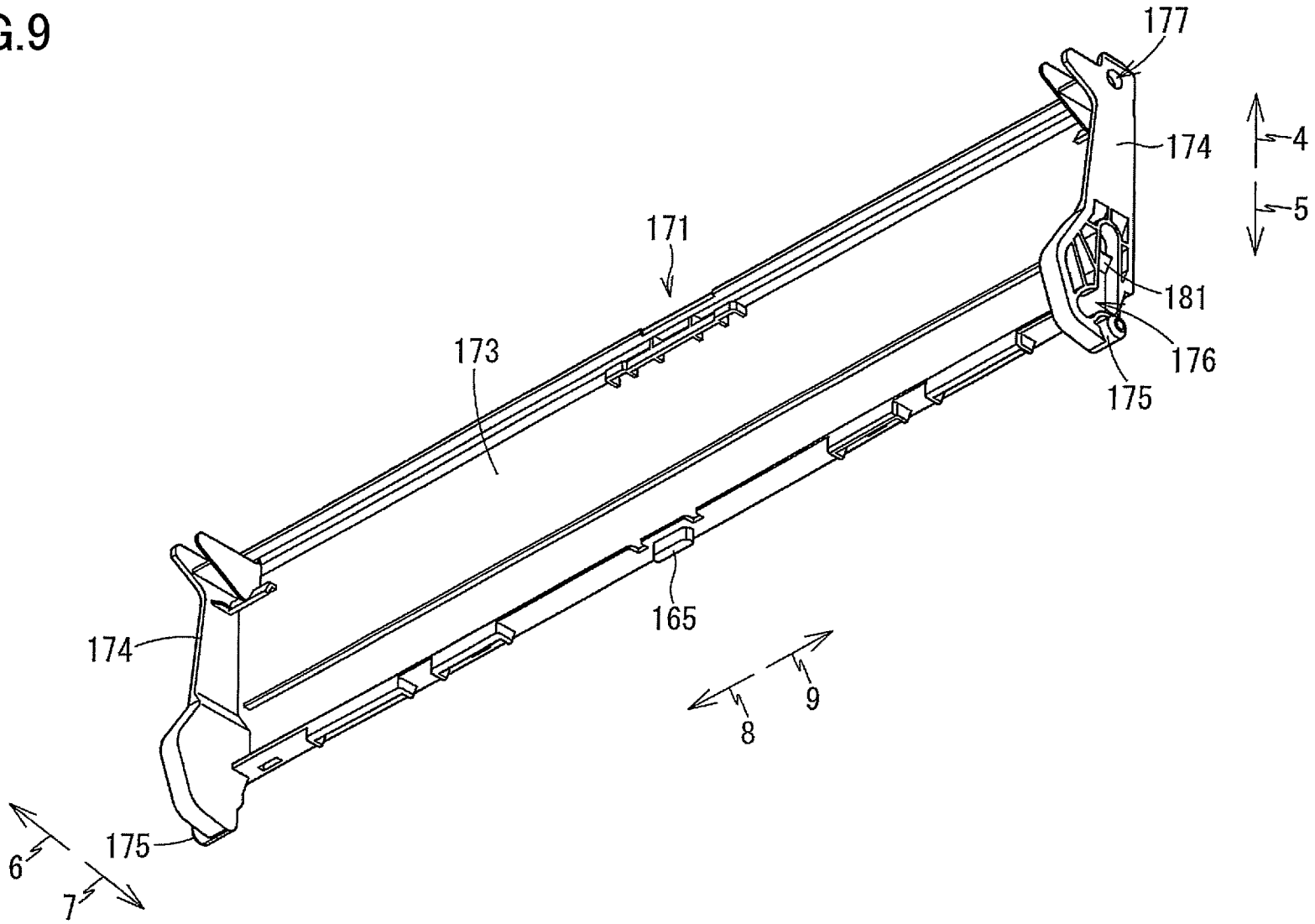
FIG. 9 is a perspective view of the first tray.

When the first tray 171 is located at the fourth position, a protrusion 165 provided on the support plate 173 of the first tray 171 (see FIG. 9) is in contact with an upper surface 163A (see FIG. 4) of the second plate 163 of the support member 151 from an upper side of the upper surface 163A. The upper surface 163A is another example of the second restrainer. This contact restrains pivotal movement of the first tray 171 from the fourth position in the direction indicated by the arrow 140. The protrusion 165 is provided at a central portion of the support plate 173 in the right and left directions 8, 9 in the present embodiment but may be provided at a portion of the support plate 173 which is different from the central portion.

The protrusion 161 is movable along the groove 179 in a direction directed from the end 179B toward the end 179A. That is, the first tray 171 is pivotable from the fourth position to the third position about the protrusions 175 in the direction indicated by the arrow 141 which is reverse to the direction indicated by the arrow 140 (see FIGS. 7A and 7B).

Effects

In the present embodiment, in order to place the recording sheet S onto the first tray 171, the first tray 171 is swung from the first position to the second position. Also, when the first tray 171 is swung to the fourth position, a space between (i) the first tray 171 and (ii) the housing 14 and the support member 151 is increased. This space allows the user to easily remove the recording sheet S jammed in the housing 14. The first tray 171 needs to be located at the third position to be swung to the fourth position. Here, the first tray 171 located at the second position is slid to move to the third position. That is, the first tray 171 located at the second position is not swung to the fourth position unless the first tray 171 is slid to the third position. This construction can stably keep the first tray 171 at the second position.

In the present embodiment, when the first tray 171 is located at the second position, the protrusion 175 is in contact with the surface 158C defining the elongated hole 158. This construction can prevent the first tray 171 located at the second position to erroneously pivot in the direction away from the first position.

In the present embodiment, when the user swings the first tray 171 from the second position in the direction away from the first position, movement of the protrusion 175 is hindered by the surface 158C. If the user nonetheless swings the first tray 171 from the second position in the direction away from the first position, the protrusion 175 may be pressed onto the surface 158C with an excessive force, which may lead to damage to the protrusion 175.

In the present embodiment, however, the surface 155C of each side member 155 serves as the first restrainer. Thus, in the case where the user swings the first tray 171 from the second position in the direction away from the first position, the first tray 171 is brought into contact with the surface 155C. Accordingly, the force is distributed to contacting portions of the protrusions 175 and the respective surfaces 158C and to a contact portion of the surface 155C and the first tray 171. This construction reduces a possibility of damage to the protrusions 175.

In the present embodiment, when the first tray 171 is located at the fourth position, the protrusion 161 is brought into contact with the surface 179C defining the groove 179. This contact can prevents the first tray 171 located at the fourth position to erroneously pivot in the direction away from the third position.

In the present embodiment, when the user swings the first tray 171 from the fourth position in the direction away from the third position, movement of the protrusion 161 is hindered by the surface 179C. If the user nonetheless swings the first tray 171 from the fourth position in the direction away from the third position, the protrusion 161 may be pressed onto the surface 179C with an excessive force, which may lead to damage to the protrusion 161.

In the present embodiment, however, the upper surface 163A of the second plate 163 provided under the first tray 171 located at the fourth position serves as the second restrainer. Thus, in the case where the user swings the first tray 171 from the fourth position in the direction away from the third position, the first tray 171 is brought into contact with the upper surface 163A from an upper side thereof. Accordingly, the force is distributed to contacting portions of the protrusions 161 and the respective surfaces 179C and to a contact portion of the upper surface 163A and the first tray 171. This construction reduces a possibility of damage to the protrusions 161.

In the present embodiment, the protrusions 181 give resistance to the sliding of the first tray 171 between the second position and the third position. This resistance reduces a possibility of erroneous sliding of the first tray 171 from the second position to the third position or from the third position to the second position.

In the present embodiment, since the first tray 171 located at the first position stands along the rear surface 88 of the housing 14, the sheet conveyor occupies a smaller space. Also, the first tray 171 located at the second position is inclined with respect to the rear surface 88, resulting in reduction in a possibility that the recording sheet S supported on the first tray 171 falls from the first tray 171.

In the present embodiment, since the first tray 171 located at the fourth position extends in the rear direction 7 from the rear surface 88 of the housing 14, the user can easily access a space inside the housing 14 with reduction in the possibility that the recording sheet S supported on the first tray 171 falls from the first tray 171.

Modifications

The MFP 10 is not limited to having the above-described construction as long as the first tray 171 is pivotable about the first shaft between the first position and the second position, slidable between the second position and the third position, and pivotable about the second shaft between the third position and the fourth position.

For example, the first tray 171 is pivotable between the first position and the second position about the protrusions 161 provided on the support member 151 and pivotable between the third position and the fourth position about the protrusions 175 provided on the first tray 171 in the above-described embodiment, but this relationship may be reversed. That is, the first tray 171 may be pivotable between the first position and the second position about the protrusions 175 provided on the first tray 171 and pivotable between the third position and the fourth position about the protrusions 161 provided on the support member 151.

That is, in the above-described embodiment, the first shaft (the protrusion 161) protrudes from the support member 151 toward the first tray 171, and the second shaft (the protrusion 175) protrudes from the first tray 171 toward the support member 151. In this modification, however, the first shaft (the protrusion 175) protrudes from the first tray 171 toward the support member 151, and the second shaft (the protrusion 161) protrudes from the support member 151 toward the first tray 171.

In the above-described embodiment, the guide (the guide 176) in which the first shaft (the protrusion 161) is to be inserted is formed in the first tray 171, and the guide (the guide 157) in which the second shaft (the protrusion 175) is to be inserted is formed in the support member 151. In this modification, however, the guide (the guide 157) in which the first shaft (the protrusion 175) is to be inserted is formed in the support member 151, and the guide (the guide 176) in which the second shaft (the protrusion 161) is to be inserted is formed in the first tray 171. It is noted that the protrusion 181 is provided on the support member 151 in this modification.

In this modification, positions of the protrusions 161, 175 and positions and lengths of the guides 157, 176 may be made different from those in the above-described embodiment such that the first tray 171 is swung and slid appropriately.

In the above-described embodiment, the slide direction in which the first tray 171 is slid between the third position and the fourth position coincides substantially with the direction in which the first tray 171 extends, but the present disclosure is not limited to this construction. For example, the slide direction need not be parallel to the direction in which the first tray 171 extends. Also, the slide direction need not extend straight and may be curved.

The printing unit 11 includes the sheet supplier 72 for supplying the recording sheet S supported on the bypass tray 71 in the above-described embodiment but may not include the sheet supplier 72. In this construction, one recording sheet S is supported on the bypass tray 71, for example. In this case, the recording sheet S is supported on the bypass tray 71 such that a leading edge of the recording sheet S in the sheet supply direction 87 is in contact with the first conveying roller pair 59.

The first tray 171 located at the first position stands along the rear surface 88 of the housing 14 in the above-described embodiment but may be inclined with respect to the rear surface 88 on condition that the free end of the first tray 171 located at the first position is nearer to the housing 14 and the support member 151 than the free end of the first tray 171 located at the second position.

The first tray 171 located at the fourth position extends in the direction substantially perpendicular to the rear surface 88 in the above-described embodiment but may extend in a direction different from the direction substantially perpendicular to the rear surface 88 on condition that the free end of the first tray 171 located at the fourth position is farther from the housing 14 and the support member 151 than the free end of the first tray 171 located at the third position.

In the above-described embodiment, the sheet conveyor is provided in the printing unit 11. However, the image recording apparatus including the sheet conveyor is not limited to the printing unit 11. For example, the sheet conveyor may be provided in the scanning unit 12. In this case, the sheet conveyor supplies the recording sheet S into the scanning unit 12 and conveys the recording sheet S in the scanning unit 12 in order for the scanning unit 12 to perform image reading on the conveyed recording sheet S.

What is claimed is:

1. A sheet conveyor, comprising:

a tray that supports a sheet; and a body that supports the tray, the body comprising a conveyance path through which the sheet supported by the tray is to be conveyed, the tray comprising a basal end and a free end and pivotable between a first position and a second position about a first shaft, the first position being a position at which the free end is located above the basal end, the second position being a position at which the tray supports the sheet in a state in which the free end is located farther from the body than the free end of the tray located at the first position, the tray being slidable along a slide direction between the second position and a third position, the tray being pivotable between the third position and a fourth position about a second shaft, the fourth position being a position at which the free end is located farther from the body than the free end of the tray located at the third position, the first shaft protruding from one of the tray and the body toward the other of the tray and the body, the second shaft protruding from the other of the tray and the body to the one of the tray and the body, the other of the tray and the body comprising a first guide that guides the first shaft in a state in which the first shaft is inserted in the first guide, the one of the tray and the body comprising a second guide that guides the second shaft in a state in which the second shaft is inserted in the second guide, the first guide comprising (i) a first elongated hole comprising a first end and a second end and extending in the slide direction and (ii) a second elongated hole comprising a first end and a second end, the first end of the second elongated hole being continuous to the first end of the first elongated hole, the second elongated hole extending in a direction in which the first shaft moves when the tray is swung from the third position to the fourth position about only the second shaft, the second guide comprising (i) a third elongated hole comprising a first end and a second end and extending in the slide direction and (ii) a fourth elongated hole comprising a first end and a second end, the first end of the fourth elongated hole being continuous to the first end of the third elongated hole, the fourth elongated hole extending in a direction in which the second shaft moves when the tray is swung from the first position to the second position about only the first shaft, the first shaft and the second shaft being respectively located at the second end of the first elongated hole and the second end of the fourth elongated hole in a state in which the tray is located at the first position, the first shaft and the second shaft being respectively located at the second end of the first elongated hole and the first end of the third elongated hole in a state in which the tray is located at the second position, the first shaft and the second shaft being respectively located at the first end of the first elongated hole and the second end of the third elongated hole in a state in which the tray is located at the third position, the first shaft and the second shaft being respectively located at the second end of the second elongated hole and the second end of the third elongated hole in a state in which the tray is located at the fourth position.

2. The sheet conveyor according to claim 1, wherein the body comprises a first restrainer that contacts the tray to restrain pivotal movement of the tray located at the second position in a direction away from the first position.

3. The sheet conveyor according to claim 2, wherein the first restrainer is a surface that contacts a portion of the tray, which portion is located on an opposite side of the first shaft from the free end in the state in which the tray is located at the second position.

4. The sheet conveyor according to claim 1, wherein the body comprises a second restrainer that contacts the tray to restrain pivotal movement of the tray located at the fourth position in a direction away from the third position.

5. The sheet conveyor according to claim 4, wherein the second restrainer is a surface formed below the tray located at the fourth position, and wherein the tray located at the fourth position contacts the second restrainer from an upper side thereof.

6. The sheet conveyor according to claim 1, wherein the other of the tray and the body comprises a protrusion protruding to a guide path for guiding the first shaft inserted in the first elongated hole, and wherein the protrusion is moved in a direction away from the guide path when the first shaft contacts the protrusion between the first end and the second end of the first elongated hole.

7. The sheet conveyor according to claim 1, wherein the tray located at the first position stands along a side surface of the body, and wherein the tray located at the second position is inclined with respect to the side surface.

8. The sheet conveyor according to claim 1, wherein the tray located at the fourth position extends in a direction substantially perpendicular to the side surface of the body.

9. The sheet conveyor according to claim 1, further comprising a sheet supplier at least partly opposed to the tray, the sheet supplier being configured to supply the sheet supported by the tray to the conveyance path, wherein the sheet supplier comprises:

a supply roller that contacts the sheet supported by the tray; and an arm comprising a distal end portion and a basal end portion, the distal end portion supporting the supply roller rotatably, the basal end portion being supported by the body such that the arm is pivotable.

10. An image recording apparatus, comprising:

a tray that supports a sheet;

a body that supports the tray, the body comprising a conveyance path through which the sheet supported by the tray is to be conveyed; and an image recorder that records an image on the sheet conveyed along the conveyance path, the tray comprising a basal end and a free end and pivotable between a first position and a second position about a first shaft, the first position being a position at which the free end is located above the basal end, the second position being a position at which the tray supports the sheet in a state in which the free end is located farther from the body than the free end of the tray located at the first position, the tray being slidable along a slide direction between the second position and a third position, the tray being pivotable between the third position and a fourth position about a second shaft, the fourth position being a position at which the free end is located farther from the body than the free end of the tray located at the third position, the first shaft protruding from one of the tray and the body toward the other of the tray and the body, the second shaft protruding from the other of the tray and the body to the one of the tray and the body, the other of the tray and the body comprising a first guide that guides the first shaft in a state in which the first shaft is inserted in the first guide, the one of the tray and the body comprising a second guide that guides the second shaft in a state in which the second shaft is inserted in the second guide, the first guide comprising (i) a first elongated hole comprising a first end and a second end and extending in the slide direction and (ii) a second elongated hole comprising a first end and a second end, the first end of the second elongated hole being continuous to the first end of the first elongated hole, the second elongated hole extending in a direction in which the first shaft moves when the tray is swung from the third position to the fourth position about only the second shaft, the second guide comprising (i) a third elongated hole comprising a first end and a second end and extending in the slide direction and a fourth elongated hole comprising a first end and a second end, the first end of the fourth elongated hole being continuous to the first end of the third elongated hole, the fourth elongated hole extending in a direction in which the second shaft moves when the tray is swung from the first position to the second position about only the first shaft, the first shaft and the second shaft being respectively located at the second end of the first elongated hole and the second end of the fourth elongated hole in a state in which the tray is located at the first position, the first shaft and the second shaft being respectively located at the second end of the first elongated hole and the first end of the third elongated hole in a state in which the tray is located at the second position, the first shaft and the second shaft being respectively located at the first end of the first elongated hole and the second end of the third elongated hole in a state in which the tray is located at the third position, the first shaft and the second shaft being respectively located at the second end of the second elongated hole and the second end of the third elongated hole in a state in which the tray is located at the fourth position.

* * * * *